US005402301A

United States Patent [19]

Mori et al.

[11] Patent Number: 5,402,301

[45] Date of Patent: Mar. 28, 1995

[54] DAMPING CIRCUIT PROVIDING CAPABILITY OF ADJUSTING CURRENT FLOWING THROUGH DAMPING COMPONENT

[75] Inventors: Shunro Mori, Tenri; Toshihide Miyake, Nara, both of Japan

[73] Assignee: Sharp Kabushiki Kaisha, Osaka, Japan

[21] Appl. No.: 995,000

[22] Filed: Dec. 22, 1992

[30] Foreign Application Priority Data

Dec. 24, 1991 [JP] Japan ..... 3-339245

[51] Int. Cl.[6] ..... H01H 47/32

[52] U.S. Cl. ..... 361/159

[58] Field of Search ..... 361/56, 159; 323/286, 323/287

[56] References Cited

U.S. PATENT DOCUMENTS

| | | | |
|---|---|---|---|
| 3,662,228 | 5/1972 | Boeters et al. | 361/159 |
| 3,705,333 | 12/1972 | Galetto et al. | 361/159 |
| 4,186,418 | 1/1980 | Seiler | 361/91 |
| 4,287,436 | 9/1981 | Tezuka et al. | 361/159 X |
| 4,733,326 | 3/1988 | Harsch et al. | 361/159 |
| 5,012,384 | 4/1991 | Chew | 361/159 |

OTHER PUBLICATIONS

Kuniaki Makabe, "Design of Control Circuit for Stepping Motor", pp. 62–75, published in 1987, Tokyo, Japan.

Hajime Kato, "IC for Controlling Small Motor", pp. 252–257, published in 1986, Tokyo, Japan.

*Primary Examiner*—A. D. Pellinen

*Assistant Examiner*—Fritz M. Fleming

[57] ABSTRACT

A damping circuit includes two circuits. Each circuit has a PNP transistor, an NPN transistor, and a shunt resistor. The PNP transistors are connected in series to the NPN transistors through level shift stages. The PNP transistor and the NPN transistor have emitter functions of the same area. The shunt resistors are connected to the emitters of the NPN transistors. Both of the two circuits are connected to a coil in parallel in such a manner that the two circuits have opposite polarities to each other about the coil.

8 Claims, 1 Drawing Sheet

DAMPING CIRCUIT PROVIDING CAPABILITY OF ADJUSTING CURRENT FLOWING THROUGH DAMPING COMPONENT

BACKGROUND OF THE INVENTION

1. Field of the Invention

The present invention relates to a damping circuit which is capable of damping a current oscillation caused across a coil when switching the coil for alternating a magnetizing direction of a magnetic body, and more particularly to the damping circuit which provides a technique for adjusting a magnitude of current flowing through a damping component.

2. Description of the Related Art

The inventors of the present application know the damping circuit, as shown in FIG. 2, which is arranged to have a coil 11, a first diode 15*a*, a second diode 15*b*, and a shunt resistor 13. Those two diodes 15*a*, 15*b* are connected in parallel to the coil 11 so that the first diode 15*a* may be directed in a reverse manner to the second diode 15*b*. The shunt resistor 13 is connected in series to both of these two diodes 15*a*, 15*b*. That is, the coil 11 is connected in parallel to the first diode 15*a* and the shunt resistor 13 connected in series to the first diode 15*a* as well as the second diode 15*b* directed reversely to the first diode 15*a* and the shunt resistor 13 connected to the second diode 15*b*.

When current flows from one terminal C to the other terminal D of the coil 11, counter electromotive force is caused between both of the terminals of the coil 11. The combination of the first diode 15*a* and the shunt resistor serves to damp the counter electromotive force caused by the current flowing in the direction. On the other hand, when current flows in an opposite manner, likewise, counter electromotive force is caused between both of the terminals of the coil 11. The combination of the second diode 15*b* and the shunt resistor 18 serves to damp the counter electromotive force caused by the current flowing in the opposite direction.

As described above, the known damping circuit uses those diodes for properly allowing or inhibiting the passage of current. However, the diode bridge circuit disables to adjust the current flowing through the shunt resistor. Therefore, the damping effect can not be improved.

SUMMARY OF THE INVENTION

It is therefore an object of the present invention to provide a damping circuit having improved damping effect.

It is another object of the present invention to provide a damping circuit which provides a shunting technique for flowing a larger magnitude of current to its shunt resistor than the known damping circuit if the voltage applied to both terminals of the coil and the shunt resistance of this circuit is the same as those of the known damping circuit.

In carrying out the object, the damping circuit according to an aspect of the invention, comprises: a first damping means for damping a counter electromotive force caused by a current flowing through the coil from a first terminal to a second terminal; and a second damping means for damping a counter electromotive force caused by a current flowing through the coil from the second terminal to the first terminal, each of said first damping means and said second damping means including a first transistor serving as an emitter follower circuit, a second transistor being connected in series to said first transistor through a level shifter stage, the second transistor having the same emitter-joint area as and an opposite polarity to the first transistor, and a shunt resistor connected to an emitter of the second transistor, the first and second damping means being connected in parallel to the coil in a manner to reverse their polarities of the damping means to each other.

The damping circuit of this invention provides a larger damping capability than the known damping circuit if the voltage applied between both terminals of the coil and the shunt resistors of the invention have the same value as that of the known circuit.

Further objects and advantages of the present invention will be apparent from the following description of the preferred embodiment of the invention as illustrated in the accompanying drawings.

DESCRIPTION OF THE PREFERRED EMBODIMENT

Hereafter, a preferred embodiment of the invention will be described as referring to FIG. 1.

Figure 1:
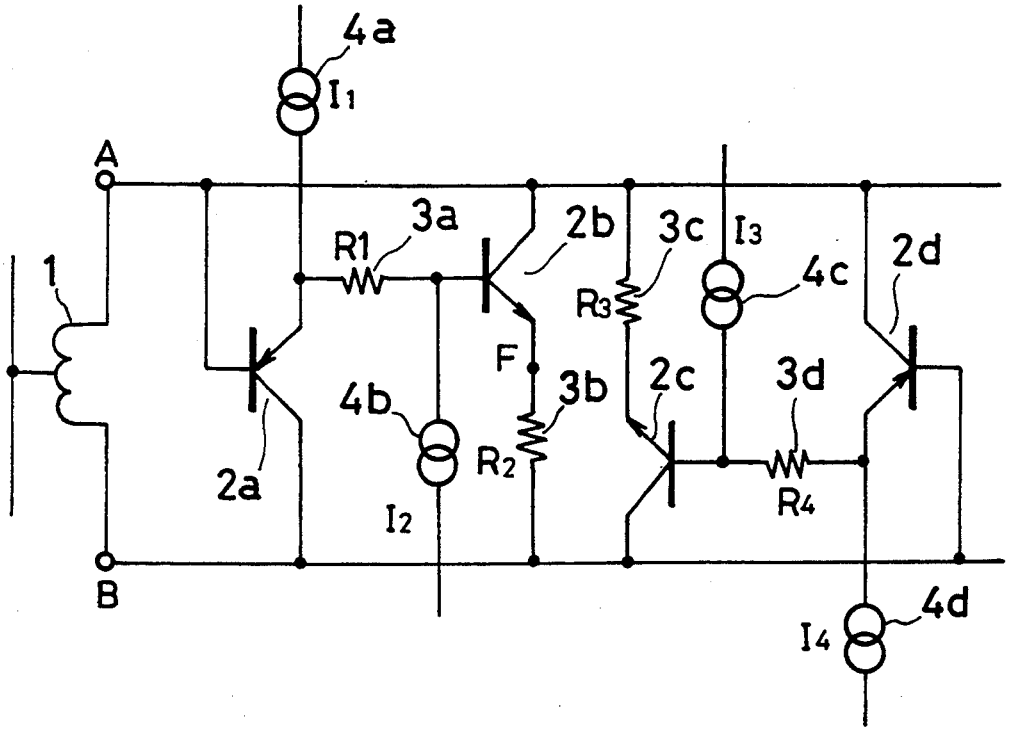
FIG. 1 is a circuit diagram showing a damping circuit according to an embodiment of the invention.

FIG. 1 shows a damping circuit of this embodiment. Numeral 1 denotes a coil. Numerals 2*a* and 2*d* denote respectively PNP transistors serving as an emitter follower circuit. Numerals 2*b* and 2*c* denote respectively NPN transistors. Numerals 3*a* and 3*d* denote respectively resistors, each for a level shift stage. Numerals 3*b* and 3*c* denote respectively shunt resistors. Numerals 4*a* and 4*d* denote constant current sources, each for supplying current to each emitter of the PNP transistors 2*a* and 2*d*. Since the joint area of the emitters of the PNP transistors 2*a* and 2*d* is equal to that of the NPN transistors 2*b* and 2*c*, the voltage $V_{PBE}$ between the base and the emitter of each PNP transistor is equivalent to the voltage $V_{NBE}$ between the base and the emitter of each NPN transistor.

The base of the PNP transistor 2*a* is connected to one terminal A of the coil 1 and the collector of the PNP transistor 2*a* is connected to the other terminal of the coil 1 so that current flows from the constant current source 4*a* to the emitter of the PNP transistor 2*a*. The emitter of the PNP transistor 2*a* is connected in series to the base of the NPN transistor 2*b* through the level shift stage composed of the resistor 3*a* and the constant current source 4*b*. The collector of the NPN transistor 2*b* is connected to the terminal A of the coil and the emitter of the NPN transistor 2*b* is connected to one end of the shunt resistor 3*b*, the other end of which is connected to the terminal B of the coil.

The PNP transistor 2*a*, the resistor 3*a*, the NPN transistor 2*b* and the resistor 3*b* serve as a first damping means.

The base of the PNP transistor 2*d* is connected to one terminal B of the coil 1 and the collector of the PNP transistor 2*d* is connected to the other terminal A of the coil 1 so that current flows from the constant current source 4*d* to the emitter of the PNP transistor 2*d*. The emitter of the PNP transistor 2*d* is connected in series to the base of the NPN transistor 2*c* through the level shift stage composed of the resistor 3*d* and the constant current source 4c. The collector of the NPN transistor 2c is connected to the terminal B of the coil and the emitter of the NPN transistor 2c is connected to one end of the shunt resistor 3c, the other end of which is connected to the terminal A of the coil.

The PNP transistor 2d, the resistor 3d, the NPN transistor 2c and the resistor 3c serve as a second damping means.

The damping circuit of this invention is characterized to provide the first damping means and the second damping means having an opposite polarity to each other about the coil 1, both of the damping means being connected in parallel.

Next, the description will be oriented to how the foregoing circuit performs the damping operation as referring to FIG. 1, in which the counter electromotive force caused when current flows from the terminal B to A of the coil is damped through the effect of the NPN transistor 2b and the shunt resistor 3b.

At first, assuming that the potential at the terminal A is via, the potential $v_{01}$ at the point F is derived by the following expression.

$$\begin{aligned} v_{01} &= V_{ia} - (-V_{BE} + I_2{*}R_1 + V_{BE}) \\ &= V_{ia} - I_2{*}R_1 \end{aligned}$$

As such, the current $I_{01}$ flowing through the shunt resistor R2 is derived as follows.

$$I_{01}=(v_{ia}-I_2{*}R_1)/R_2$$

Figure 2:
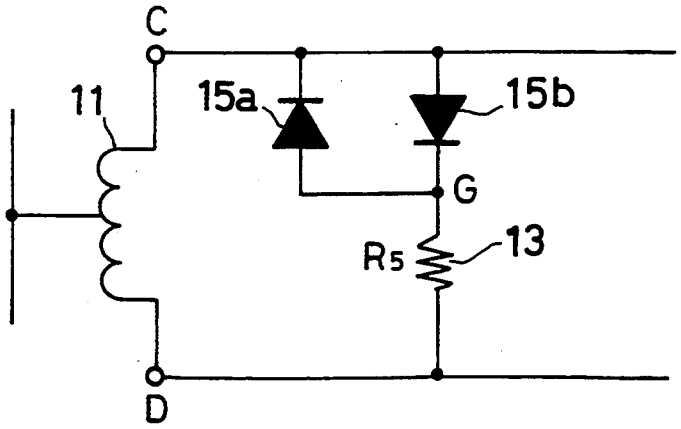
Fig. 2 PRIOR ART
FIG. 2 is a circuit diagram of the known damping circuit.

On the other hand, considering the known damping circuit of the related art shown in FIG. 2, assuming that the potential at the terminal corresponding to the terminal A of FIG. 1 is $v_{ic}$ and a forward voltage of the diode 15a is $V_F$, the potential $v_{02}$ at a contact G between the first diode or the second diode directed in an opposite manner and the shunt resistor is derived as follows.

$$v_{02}=v_{ic}-V_F$$

Hence, the current $I_{02}$ flowing through the shunt resistor becomes as follows.

$$I_{02}=(v_{ic}-V_F)/R_5$$

where the potential $v_{ia}$ is equivalent to the potential $v_{ic}$.

Assuming that the shunt resistor $R_2$ of the embodiment has the same resistance as that of the known circuit, therefore, the voltage $V_F$ is a fixed value, while $I_2{*}R_1$ is allowed to be adjusted into a lower value than $V_F$ since a value of $I_2$ can be changed. That is, the know circuit disables to adjust the current flowing through the shunt resistor, while the circuit of this embodiment enables to do it.

Now, the description will be directed to the operation of the forgoing circuit to damp the counter electromotive force caused by the current flowing from the terminal B to the terminal A.

The level shift stage consisting of the resistor 3a and the constant current source 4b operates to switch the NPN transistor 2b on. The emitter level $V_{AE}$ of the NPN transistor 2b at this time point A is derived as follows by using a base to emitter voltage $V_{PBE}$ of the PNP transistor 2a, a voltage $R_1{*}I_2$ caused by flowing the current $I_2$ through the resistor 3a, and a base to emitter voltage $V_{NBE}$ of the NPN transistor 2b.

$$V_{AE}=-V_{PBE}+R_1{*}I_2+V_{NBE}$$

Since $V_{PBE}=V_{NBE}$, $V_{AE}=R_1{*}I_2$ is established.

By reducing the current magnitude of the constant current source $I_{12}$, therefore, the current flowing through the shunt resistor 3b is made larger so that the shunt resistor 3b may provide a larger damping effect on the vibrations caused when switching the coil from the terminals A to B than the known circuit.

Likewise, the counter electromotive force caused by the coil when the current flows from the terminals A to B is damped through the effect of the shunt resistor 3c and the NPN transistor 2c.

The level shift stage consisting of the resistor 3d and the constant current source 4c operates to switch the NPN transistor 2c on. The emitter level $V_{AE}$ of the NPN transistor 2c at this time point A is derived as follows by using a base to emitter voltage $V_{PBE}$ of the PNP transistor 2d, a voltage **R4*I3 caused by flowing the current $I_3$ through the resistor 3d, and a base to emitter voltage $V_{NBE}$ of the NPN transistor 2c**.

$$V_{AE}=-V_{PBE}+R4{*}I3+V_{NBE}$$

Since $V_{PBE}=V_{NBE}$, $V_{AE}=R4{*}I_3$ is established.

By reducing the current magnitude of the constant current source $I_3$, therefore, the current flowing through the shunt resistor 3c is made larger so that the shunt resistor 3c may provide a larger damping effect on the vibrations caused when switching the coil from the terminals B to A than the known circuit.

Many widely different embodiments of the present invention may be constructed without departing from the spirit and scope of the present invention. It should be understood that the present invention is not limited to the specific embodiments described in the specification, except as defined in the appended claims.

What is claimed is:

1. A damping circuit for damping a counter electromotive force caused by a current flowing through a coil having first and second terminals, comprising:

a first damping means for damping a first counter electromotive force caused by a current flowing through the coil from the first terminal to the second terminal; and a second damping means for damping a second counter electromotive force caused by a current flowing through the coil from the second terminal to the first terminal, each of said first damping means and said second damping means including a first transistor serving as an emitter follower circuit, a second transistor being connected in series to said first transistor through a level shift stage, said first and second transistors having respectively emitter junctions of the same area and polarities opposite to each other, and a shunt resistor connected to an emitter of said second transistor, said first and second damping means being connected in parallel to the coil and having a polarities opposite to each other about the coil.

2. A damping circuit as claimed in claim 1, wherein said first transistor is a PNP transistor and said second transistor is an NPN transistor.

3. A damping circuit as claimed in claim 2, wherein the base, the emitter and the collector of the first transistor of the first damping means are connected to the second terminal of the coil, the level shift stage of the first damping means and the first terminal of the coil, respectively.

4. A damping circuit as claimed in claim 2, wherein the base, the emitter and the collector of the first transistor of the second damping means are connected to the first terminal of the coil, the level shift stage of the second damping means and the second terminal of the coil, respectively.

5. A damping circuit as claimed in claim 1, wherein said level shift stage of each of said first and second damping means includes a resistor and a constant current source.

6. A damping circuit as claimed in claim 2, wherein the base of said second transistor of each of said first and second damping means is connected to respective one of constant current sources.

7. A damping circuit as claimed in claim 2, wherein the collector of said second transistor and the shunt resistor of said first damping means are connected to said second terminal of the coil and the first terminal of the coil, respectively.

8. A damping circuit as claimed in claim 2, wherein the collector of said second transistor and the shunt resistor of said second damping means are connected to said first terminal of the coil and said second terminal of the coil, respectively.

* * * * *